US005699645A

United States Patent [19]

Vaccarello

[11] Patent Number: 5,699,645

[45] Date of Patent: Dec. 23, 1997

[54] MOLDED BIODEGRADABLE PACKAGING

[75] Inventor: Ronald Vaccarello, Mullica Hill, N.J.

[73] Assignee: NOREL, Little Ferry, N.J.

[21] Appl. No.: 747,588

[22] Filed: Nov. 13, 1996

[51] Int. Cl.[6] ..... B65B 61/00

[52] U.S. Cl. ..... 53/139.5; 53/472; 206/584

[58] Field of Search ..... 53/472, 139.5, 53/155, 238, 445, 111 R, 111 RC, 431; 206/584, 524

[56] References Cited

U.S. PATENT DOCUMENTS

| | | | |
|---|---|---|---|
| 3,446,882 | 5/1969 | Landon | 206/524 |
| 3,536,190 | 10/1970 | Hirsch et al. | 206/524 |
| 3,870,741 | 3/1975 | Kuhn | 206/524 |
| 3,871,521 | 3/1975 | Szatkowski | 206/524 |
| 4,042,658 | 8/1977 | Collins | 206/584 |
| 5,186,990 | 2/1993 | Starcevich | 206/584 |
| 5,199,244 | 4/1993 | Beier et al. | 53/111 R |
| 5,362,776 | 11/1994 | Barenberg et al. | 524/35 |
| 5,623,815 | 4/1997 | Hornstein et al. | 53/431 |

*Primary Examiner*—John Sipos
*Assistant Examiner*—John Paradiso
*Attorney, Agent, or Firm*—Kane, Dalsimer, Sullivan, Kurucz, Levy, Eisele and Richard

[57] ABSTRACT

The disclosure is of portable apparatus for packaging articles, and cushioning the packages with biodegradable, starch based materials. The materials, packed as loose nuggets within the package, are converted to a single, unitary cushion in-situ to protect the article.

3 Claims, 3 Drawing Sheets

MOLDED BIODEGRADABLE PACKAGING

BACKGROUND OF THE INVENTION

1. Field of The Invention

The invention relates to apparatus for packaging articles and more particularly relates to apparatus for dispensing molded, biodegradable materials to package articles for shipment and storage.

2. Brief Description of The Prior Art

A concise summary of the state of the art appears in U.S. Pat. No. 5,362,776 wherein it is stated that:

"Several problems are associated with conventional packaging materials, such as expanded polystyrene peanuts."

The patentee in the U.S. Pat. No. 5,362,776 approaches the problems associated with the state of the art by providing a cellulosic, recyclable product in admixture with a softener and a water-soluble binder. The softener is in fact glycerin, deemed essential to the invention. A percentage of residual water is also required, which can adversely affect some moisture-sensitive articles for packaging.

A primary problem associated with the use of all of the cushioning materials described above, concerns their loose disposition within the package holding the article. The materials are subject to movement and shifting due to handling. When the package is opened, the loose fill also creates clean-up and disposal problems. Of course, these clean-up problems are not associated with the earlier in-situ foam packaging techniques (see for example the descriptions in U.S. Pat. Nos. 3,190,442 and 3,204,385) employing synthetic resin foams generated in the spaces around an article to be shipped. Unfortunately, these synthetic resin foams are generally not environmentally acceptable for disposal and/or use. They also require relatively long cure times, before the foam is completely formed and hardened.

The apparatus of the invention represents an improvement in the art, in that biodegradable, environmentally acceptable, loose materials are employed which are molded into solid cushions which conform to the spaces to be filled around an article, within a package. The apparatus is easy to handle and portable for use on a moving packaging line.

SUMMARY OF THE INVENTION

The invention comprises apparatus for packaging articles within a shipping container, which comprises;

means for holding a quantity of loose nuggets of a biodegradable, shaped material defined at least in part by an exposed starch surface;

conduit means in open communication with the means for holding, at a location wherein the loose nuggets will flow by gravity into the conduit means, said conduit means having a first open end in communication with the means for holding and a distal second open end for the discharge of carried nuggets;

valve means on the conduit for controlling flow of the nuggets through the conduit, and moisture applying means on the second end of the conduit for applying a spray of moisture onto at least a portion of exposed starch surface of the nuggets.

DETAILED DESCRIPTION OF THE PREFERRED EMBODIMENTS OF THE INVENTION

Those skilled in the art will gain an appreciation and understanding of the invention from a viewing of the accompanying drawings of FIGS. 1–4 in conjunction with a reading of the following description of the preferred embodiments of the invention.

Figure 1:
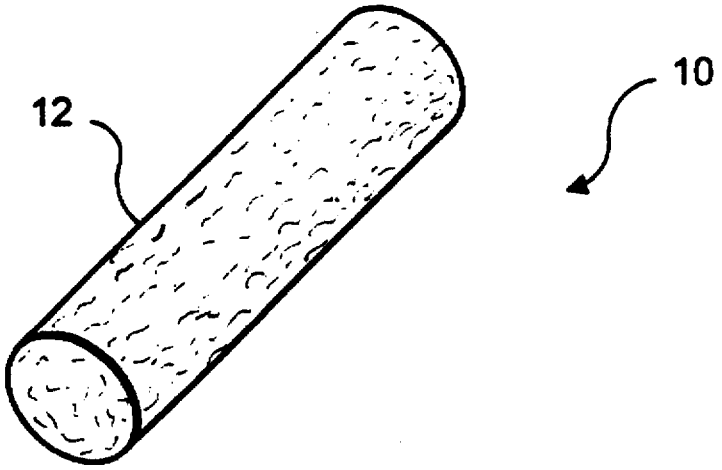
FIG. 1 is a view-in-perspective of a starch-containing nugget of the prior art, employed in the present invention.

Referring first to FIG. 1, there is seen a perspective view of an embodiment nugget 10 employed in the method of the invention. The nugget 10 is a conventional packing material used in the prior art to package articles. The nugget 10 may be, for example, a biodegradable, shaped and expanded starch containing product such as described in the U.S. Pat. Nos. 4,863,655; 5,035,930; and 5,043,196, all of which are hereby incorporated herein by reference thereto. The essential feature of the nugget 10 is definition, at least in part, by an exposed surface 12 of a starch material. Starch materials include unmodified natural granular starches such as regular cereal, potato, and tapioca starch, and flours containing the same, as well as mixtures of these with waxy starches and high amylose starches. Full-fat starches, that is, starches which have not had a portion of the bound fat removed, are suitable for use herein.

Starch is a low-cost and abundant natural polymer composed of amylose and amylopectin. Amylose is essentially a linear polymer having a molecular weight in the range of 100,000–500,000, whereas amylopectin is a highly branched polymer having a molecular weight of up to several million. When starch is gelatinized in water and cooled, the amylose retrogrades to a much greater extent than the amylopectin fraction. Retrogradation is a term applied to the phenomenon whereby starch chains in dispersion associate, become insoluble, and precipitate. The rate and extent of retrogradation depend on properties of dispersion and on the amount of amylose present in the dispersion. While common cornstarch (pearl) contains about 25% amylose and 75% amylopectin, the waxy corn starches contain only amylopectin and those referred to as high-amylose starches contain up to 75% amylose.

A preferred starch material for the low density, biodegradable nuggets 10 employed in the method of the invention are the expanded material described in U.S. Pat. No. 4,863,655. Starches having an amylose content of up to about 25% gelatinize at a temperature of about 120° to 135° C. Starches having greater than about 25% amylose require temperatures of about 155°–160° C. Gelatinization at lower temperatures does not cause complete granule rupture, while gelatinization at higher temperatures causes some starch depolymerization.

Figure 2:
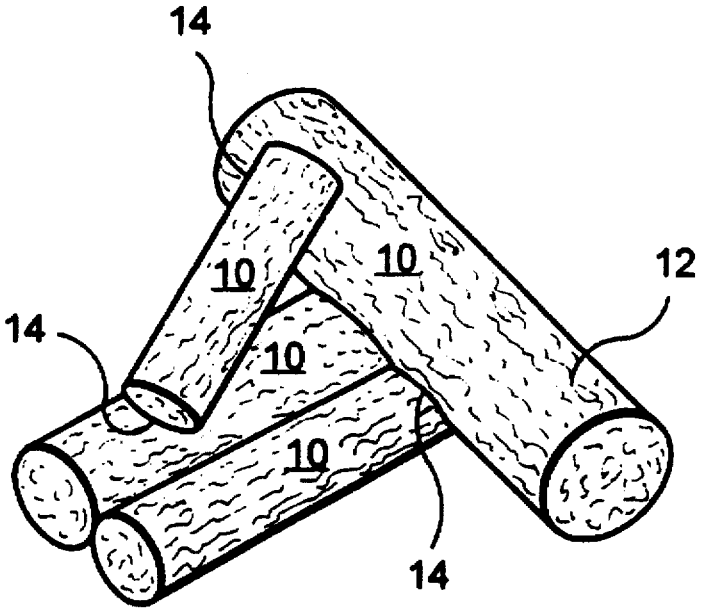
FIG. 2 is a side view showing a plurality of nuggets as shown in FIG. 1, adhered together at points of contact between adjacent nuggets to form a solid cushion to protect a packaged article.

When surface portions 12 of nuggets 10 are gelatinized or wetted, the surface 12 becomes tacky and adhesive in nature. If the moistened surfaces 12 are brought into contact with adjacent nuggets 10, and retrogradation allowed to occur, the nuggets 10 will adhere and bond together at contact sites 14 as shown in FIG. 2. A solid structure is thereby made from a plurality of loose nuggets 10, which forms a single, integrated and solid cushion of material which can effectively cushion an article to be packaged in a container.

Figure 3:
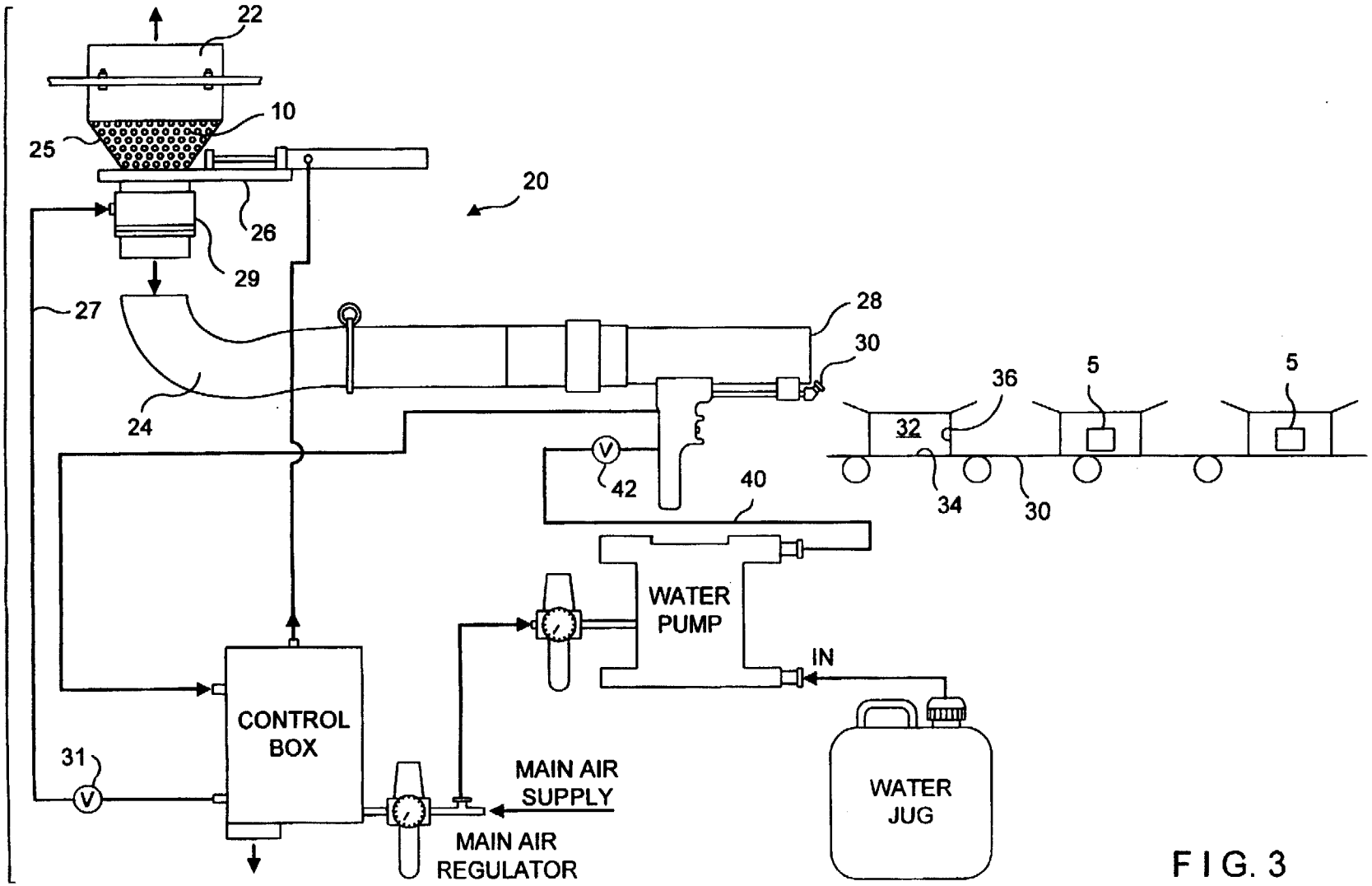
FIG. 3 is a cross-sectional side view of embodiment apparatus of the invention.

Referring now to FIG. 3, there is seen a cross-sectional side view, embodiment apparatus 20 of the invention for carrying out the method of the invention. The apparatus 20 comprises a storage hopper 22 for holding a quantity of loose nuggets 10 as described above. An accumulator zone 26 at the base of hopper 22 receives a measured quantity of nuggets 10 sufficient to package a single unit of product and functions to discharge that measured amount upon opening of the valve 26. A flexible tubular conduit 24 in open communication with the interior of hopper 22 carries the nuggets 10 downward by force of gravity to a valve 26 which acts as a gate to restrict flow of the nuggets 10 within conduit 24. The lower, open end 28 of conduit 24 functions as a nozzle to direct the falling nuggets 10, when not restricted in passage by valve 26, into a process line for carrying out the method of the invention. The process line may comprise a conveyor line 30 carrying containers 32 to receive nuggets 10 as space filler to fill the space between a contained article for shipment, the container 32 bottom 34 and sidewalls 36. Prior to the deposit of nuggets 10 into containers 32, and before leaving the open end 28 of conduit 24, at least a portion of the nuggets 10 are wetted with moisture inserted into the flowing nuggets 10 through a spray nozzle 30 of conduit 24 near the open end 28. The spray nozzle 30 dispenses a mist spray of water received from water supply line 40 upon actuation of valve 42. The mist spray functions to at least partially gelatinize surfaces 12 of the nuggets 10 as previously described, immediately after release by valve 26 but before deposit into container 32 from conduit 24 open end 28. The brief, momentary exposure to water serves to gelatinize only surface portions 12 of the nuggets 10 and not the whole of the nugget 10, or even the whole of dispensed nuggets 10. To assist conveyance of nuggets 10 through conduit 24, an air amplifier 29 receives compressed air from line 27, when valve 31 is opened. The pulse of compressed air creates suction from the back end of conduit 24 assisting in the carrying of the nuggets out of nozzle end 28. the opening of valve 31 can be coordinated with the opening of valve 26. As the nuggets 10 fill and occupy the space between the article 5 and the bottom 34 and sidewalls 36 of containers 32, adjacent nuggets 10 pack together and where they make contact with gelatinized surfaces 12 will adhere together and form a solid, integrated cushion from the previously loose filled nuggets 10. The gelatinization is so light and minimal that within 1 to 3 minutes of making contact, retrogradation occurs and the nuggets 10 become firmly adhered at contact sites. Although this adherence is strong enough to resist shifting of the individual nuggets during handling of the package, the frangibility of the adhered mass is such that upon unpacking of the article 5, the cushion can be easily broken up and disposed of in an environmentally sound manner, i.e.; by dissolution and degradation with water.

Those skilled in the art will appreciate that many modifications may be made to the preferred embodiments described above, without departing from the spirit and the scope of the invention. For example, the articles 50 for packaging according to the method of the invention may be pre-wrapped in a film of a synthetic polymeric resin such as polyethylene for additional protection.

Figure 4:
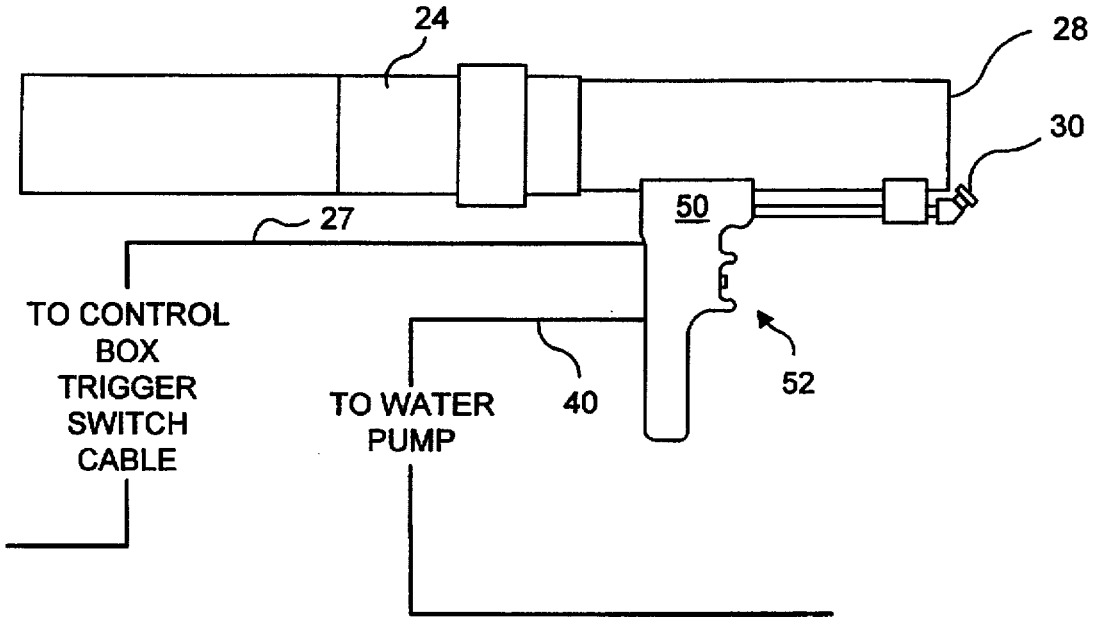
FIG. 4 is a cross-sectional side elevation of a preferred control means for dispensing nuggets and moisture from the apparatus of the invention.

Referring now to FIG. 4, a cross-sectional side elevation of a preferred control means is shown attached to the conduit end 28. A hand-grip 50 permits the operator to carry the nozzle end 24 to any location for application of the nuggets 10. Finger operated control 52 means on the hand-grip 50 operates opening simultaneously of valves 26, 31 and valve 42 for wetting the conveyed nuggets 10. The unit is portable and readily operated.

What is claimed is:

1. Apparatus for packaging articles within a shipping container, which comprises:

means for holding a quantity of loose nuggets of a biodegradable, shaped material defined at least in part by an exposed starch surface;

conduit means in open communication with the means for holding, at a location wherein the loose nuggets will flow by gravity into the conduit means, said conduit means having a first open end in communication with the means for holding and a distal second end for the discharge of carried nuggets;

valve means on the conduit for controlling flow of the nuggets through the conduit;

moisture applying means located outside the second distal end of the conduit for applying a spray of moisture onto at least a portion of exposed starch surface of said nuggets after said nuggets have left said distal second end and are exposed to air, whereby the surfaces of said nuggets are gelatinized; and means for supporting a shipping container for receiving said nuggets.

2. Apparatus of claim 1 including means for applying a water mist to the nuggets leaving the conduit.

3. Apparatus of claim 1 including an air amplifier to assist in conveying the nuggets through the conduit.

* * * * *